US006006564A

United States Patent [19]

Frisby et al.

[11] Patent Number: 6,006,564

[45] Date of Patent: Dec. 28, 1999

[54] APPLICATION OF DRY LUBRICANT TO FORMING DIES AND FORGING DIES THAT OPERATE WITH HIGH FORCE

[75] Inventors: Daniel G. Frisby, Marysville; David M. McCray, Tipp City; Brian W. Schneider, Sidney, all of Ohio

[73] Assignee: Honda of America Mfg., Inc., Marysville, Ohio

[21] Appl. No.: 09/208,643

[22] Filed: Dec. 10, 1998

[51] Int. Cl.[6] ..... B21B 45/02; B21C 37/02

[52] U.S. Cl. ..... 72/41; 72/379.2; 72/354.6

[58] Field of Search ..... 72/41, 42, 352, 72/354.6, 355.4, 347, 348, 379.2

[56] References Cited

U.S. PATENT DOCUMENTS

| | | | |
|---|---|---|---|
| 3,632,368 | 1/1972 | Nelson | 117/16 |
| 3,869,894 | 3/1975 | Meyer et al. | 72/42 |
| 4,403,490 | 9/1983 | Sargent | 72/42 |
| 4,416,132 | 11/1983 | Sargent | 71/41 |
| 4,553,417 | 11/1985 | Badger | 72/42 |
| 4,612,128 | 9/1986 | Uematsu et al. | 252/32.5 |
| 4,753,094 | 6/1988 | Spears | 72/53 |
| 5,116,521 | 5/1992 | Fujii et al. | 251/18 |

FOREIGN PATENT DOCUMENTS

| | | | |
|---|---|---|---|
| 2-187229 | 7/1990 | Japan | 72/41 |
| 650-696 | 3/1979 | U.S.S.R. | 72/41 |

OTHER PUBLICATIONS

B.P. Bandyopadhyay, E. Fabiszak, G.R. Fenske, and F.A. Nichols, Investigation of Tribological Properties of Hard Coatings for Cutting Tools, Japan International Tribology Conference, Nagoya, Japan, Oct. 29–Nov. 1, 1990.

G.R. Fenske, N. Kaufherr, R.H. Lee, B.M. Kramer, R.F. Bunshah, and W.D. Sproul, Characterization of Coating Wear Phenomenon in Nitride– and Carbide–Coated Tool Inserts, 15th International Conference on Metallurgical Coatings, San Diego, CA, U.S.A., Apr. 11–15, 1988, pp. 791–800.

*Primary Examiner*—Rodney Butler
*Attorney, Agent, or Firm*—Monica H. Choi

[57] ABSTRACT

The present invention applies dry lubricant to appropriate components of a forming die of a stamping press to minimize frictional force against such components during operation of the forming die or to appropriate components of a forging die of a forging press to minimize shear force against such components during operation of the forging die. A layer of dry lubricant is applied to any one or more of the die, the punch, or the binder of a forming die of a stamping press, and a layer of hard chrome may also be plated thereon before the layer of dry lubricant is applied. A layer of dry lubricant is applied on the inner surface of a cavity within a forging die of a forging press of the present invention. A dry lubricant may also be applied on the outer surface of the punch of the forging press.

43 Claims, 4 Drawing Sheets

APPLICATION OF DRY LUBRICANT TO FORMING DIES AND FORGING DIES THAT OPERATE WITH HIGH FORCE

TECHNICAL FIELD

The present invention relates to stamping presses and forging presses which use high force to manufacture steel parts, and more particularly to application of a dry lubricant onto a forming die of such a stamping press to reduce scrap or onto a forging die of such a forging press to prolong the usable life of the forging die.

BACKGROUND OF THE INVENTION

The use of dry lubricants for certain applications is known in the prior art. For example, U.S. Pat. No. 3,632,368 to Meyer et al., U.S. Pat. No. 4,403,490 to Sargent, U.S. Pat. No. 4,416,132 to Sargent, U.S. Pat. No. 4,553,417 to Badger, U.S. Pat. No. 4,612,128 to Uematsu et al., and U.S. Pat. No. 5,116,521 to Fujii et al. disclose the application of lubricants including a dry lubricant to the work piece or the blank before a part is formed. The dry lubricant may include molybdenum disulfide ($MoS_2$) or tungsten disulfide ($WS_2$). A disadvantage with application of the dry lubricant to the work piece is that added cost and labor is required in applying the dry lubricant to each work piece and in removing the applied lubricant from the part after the part is formed from the work piece. In addition, such removal of the lubricant from the part may require additional chemicals and may create environmentally hazardous waste.

U.S. Pat. No. 3,632,368 to Nelson discloses application of a dry lubricant on bearings. In addition, U.S. Pat. No. 4,753,094 to Spears discloses application of a dry lubricant on die cast molds for dealing with problems in releasing the part from the mold, on cutting tools for dealing with problems in preserving the sharpness of a cutting edge, and on sliding bearing surfaces to minimize friction between the bearings. Furthermore, the manuscript with title *Investigation of Tribological Properties of Hard Coatings for Cutting Tools* by Bandyopadhyay et al. presented at the Japan International Tribology Conference in Nagoya, Japan, 1990 discloses application of a dry lubricant on cutting tools.

However, the prior art does not show the application of a dry lubricant on the forming die of a stamping press or on the forging die of a forging press which use high force for forming a part with flow of material within the forming die or the forging die. Experiments by applicants indicate that application of a dry lubricant to the appropriate portions of the forming die of a stamping press results in a significant reduction in scrap. Furthermore, experiments by applicants indicate that application of a dry lubricant to the appropriate portions of the forging die of a forging press results in consistent prolonged usable life of the forging die.

SUMMARY OF THE INVENTION

Accordingly, the present invention relates to the application of a dry lubricant on a forming die of a stamping press such that the scrap rate is significantly reduced when the stamping press is operated and to the use of a dry lubricant on a forging die of a forging press such that the usable life of the forging die is consistently prolonged.

Generally, the present invention includes the step of applying a dry lubricant to at least one of a die, a punch, and a binder of a forming die of a stamping press. A metal blank is fed to be held by the binder between the die and the punch of the forming die. A part, such as an automotive part, is stamped from the metal blank by moving at least one of the die and the punch with high force such that the die and the punch come together while the metal blank is held by the binder between the punch and the die. A plurality of parts are produced from a plurality of metal blanks with one application of the dry lubricant to at least one of the die, the punch, and the binder of the forming die.

With the dry lubricant appropriately applied on the forming die in a stamping press, the scrap rate is significantly reduced.

The present invention may be used to particular advantage when hard chrome is plated onto at least one of the die, the punch, and the binder before the dry lubricant is applied thereon.

In another aspect of the present invention, the dry lubricant is appropriately applied on a punch and a forging die of a forging press, to prolong the usable life of the forging die. The forging die has a cavity for defining the shape of a part, such as an automotive part, to be produced by the forging press. A dry lubricant is applied onto the inner surface of the cavity of the forging die. A metal blank is placed into the cavity of the forging die. A part is formed from the metal blank by pushing a punch into the metal blank placed in the cavity of the forging die with high force such that metal within the metal blank flows and conforms to the shape of the punch and the cavity of the forging die. A plurality of parts are produced from a plurality of metal blanks with one application of the dry lubricant onto the inner surface of the cavity of the forging die.

The forging die may include a separate forging die insert held by a retaining ring, or the forging die insert and the retaining ring may be combined to form a single die element.

In this manner, as the metal within the metal blank flows against the surface of the cavity of the forging die, the dry lubricant minimizes the shear stress against the inner surface of the cavity from the metal flow against such surface. Thus, the forging die is less prone to cracking and breakage during operation of the forging press, and the usable life of the forging die is prolonged with the present invention.

These and other features and advantages of the present invention will be better understood by considering the following detailed description of the invention which is presented with the attached drawings.

BRIEF DESCRIPTION OF THE DRAWINGS

FIG. 4, including

The figures referred to herein are drawn for clarity of illustration and are not necessarily drawn to scale. Elements having the same reference number in FIGS. 1, 2, 3, 4, 5, 6, and 7 refer to elements having similar structure and function.

DETAILED DESCRIPTION

Figure 1:
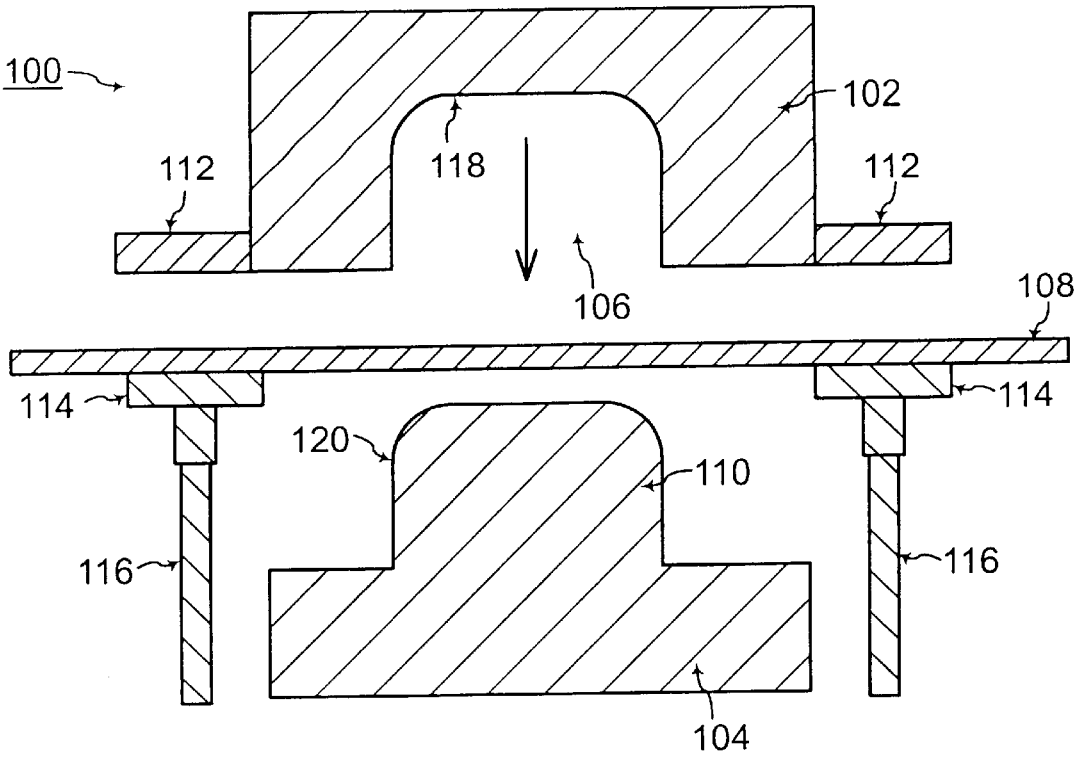
FIG. 1 (Prior Art)
FIG. 1 shows a cross sectional view of a forming die of a stamping press, according to the prior art.
Figure 2:
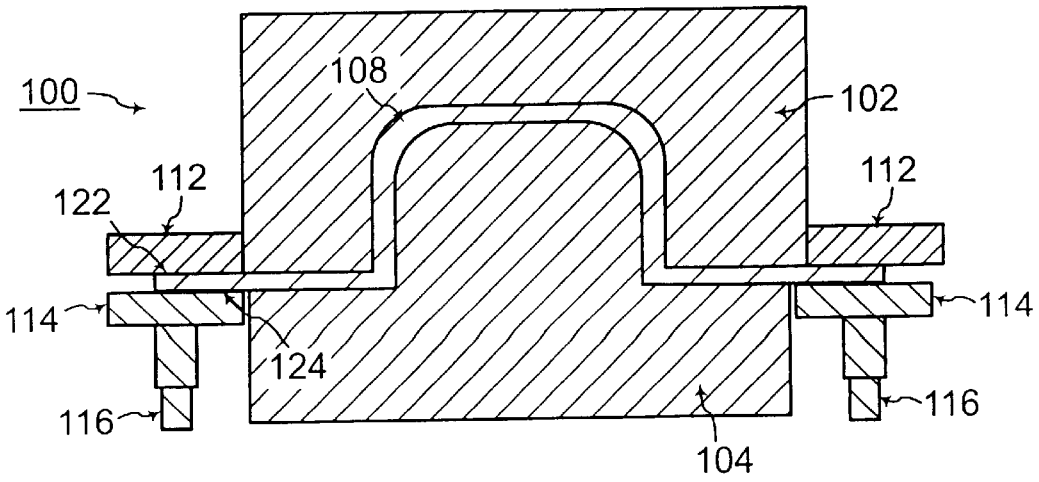
FIG. 2 illustrates the operation of the forming die of FIG. 1 when a part is produced from a metal blank.

Referring to FIG. 1, a cross sectional view of a forming die 100 of a stamping press includes a die 102 and a punch 104. The die 102 has a cavity 106 for defining the shape of a part to be formed from a metal blank 108. The punch 104 has a protrusion 110 which corresponds to the shape of the cavity 106 for defining the shape of the part to be formed from the metal blank 108. The protrusion 110 of the punch 104 fits into the cavity 106 of the die 102 when the die 102 and the punch 104 come together to form the part from the metal blank 108 as shown in FIG. 2. Elements having the same reference number in FIGS. 1 and 2 refer to elements having similar structure and function.

Figure 3:
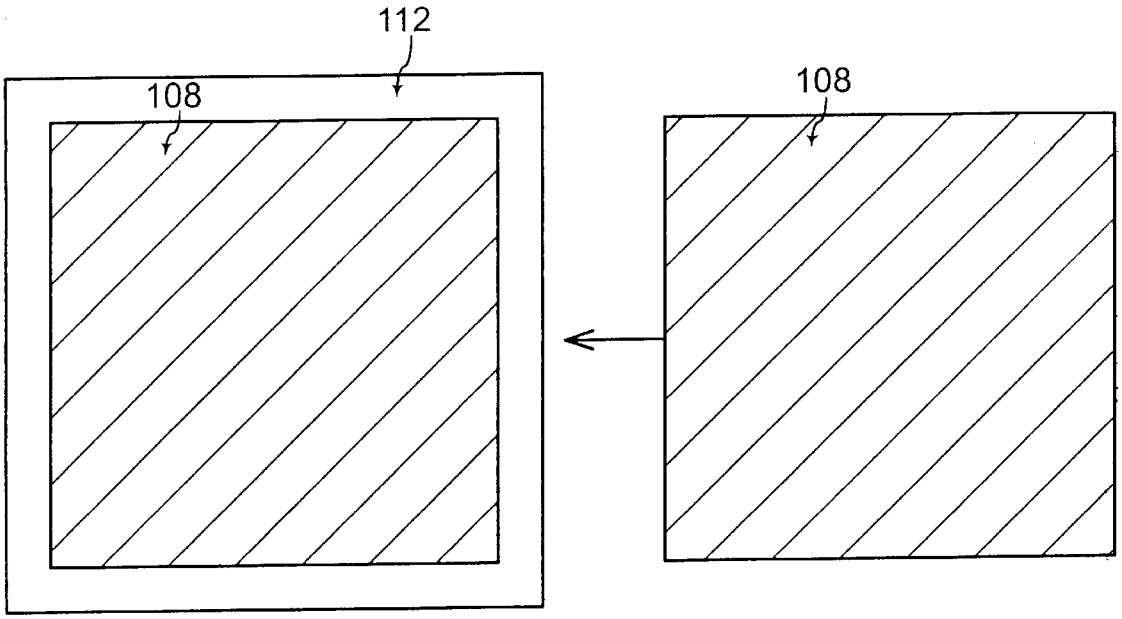
FIG. 3 shows a top view of the forming die of FIG. 1 without the die.

A binder holds the metal blank 108 in place as the die 102 and the punch 104 come together to form the part from the metal blank 108 as shown in FIG. 2. Referring to FIG. 3, which shows a top view of the forming die 100 of FIG. 1, an upper binder 112 is disposed around the die 102. A lower binder 114 is disposed around the punch 104. The lower binder 114 sits on top of a cushion system 116 which is forced downward by the upper binder 112 when the die 102 and the punch 104 come together to form the part from the metal blank 108 as shown in FIG. 2.

Referring to FIG. 2, when the die 102 and the punch 104 come together to form the part from the metal blank 108, metal within the metal blank 108 forms, stretches, and flows to conform to the shape of the cavity 106 of the die 102 and the protrusion 110 of the punch 104 during a forming process. During such a forming process, the metal within the metal blank 108 flows against the inner surface 118 of the cavity 106, against the outer surface 120 of the protrusion 110, against the lower surface 122 of the upper binder 112, and against the upper surface 124 of the lower binder 114.

When the die 102 and the punch 104 come together to form the part from the metal blank 108, at least one of the die 102 and the punch 104 are moved toward the other part with relatively high force such that the die 102 and the punch 104 come together as shown in FIG. 2. Referring to FIG. 1, with such high force, the metal within the metal blank 108 flows with much frictional force against surfaces of the forming die 100 including the inner surface 118 of the cavity 106, the outer surface 120 of the protrusion 110, the lower surface 122 of the upper binder 112, and the upper surface 124 of the lower binder 114. Such high frictional force from the flow of metal against such surfaces affects the integrity of such surfaces. For example, the surfaces may wear down or the surfaces may deform in shape with galling or build-up on the surfaces as a plurality of parts are produced in the forming die 100.

Figure 4A:
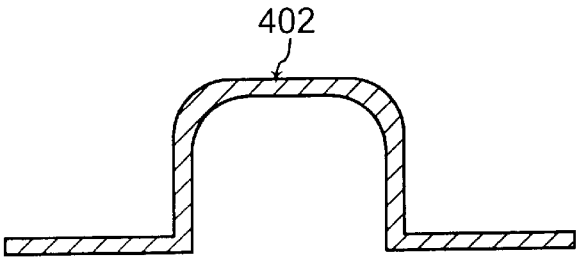
FIG. 4A (Prior Art)
FIGS. 4A and 4B, shows a part formed from the forming die of FIG. 1 with defects which results in scrap.
Figure 4B:
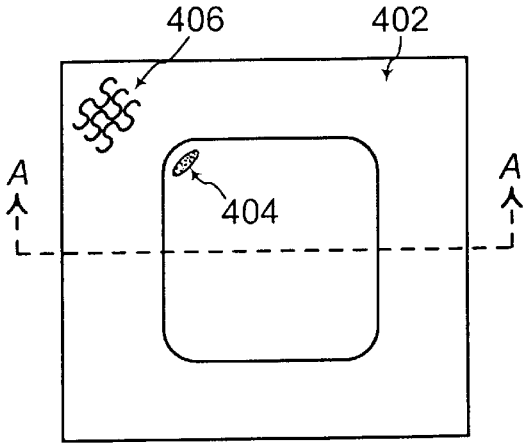
FIG. 4B (Prior Art)

Referring to FIG. 4, FIG. 4A shows a cross-sectional view of a part 402 formed from the metal blank 108 within the forming die 100 of FIG. 1. FIG. 4B shows a top view of the part 402, and FIG. 4A is a cross-section of the part 402 along line A—A in FIG. 4B. Referring to FIGS. 1 and 2, when the surfaces, such as the inner surface 118 of the cavity 106, the outer surface 120 of the protrusion 110, the lower surface 122 of the upper binder 112, and the upper surface 124 of the lower binder 114 wears or deforms with the frictional force from metal flow, the part 402 may be produced with defects. Referring to FIG. 4B, a top view of the part 402 shows a stress and compression crack 404 and a deformation in shape 406 that may result when the surfaces of the forming die 100 have been worn or deformed in shape.

The part 402 having such defects typically cannot be used and is a scrap. A scrap results in loss of profit, and a reduction in the number of scraps is desired. The present invention uses dry lubricant applied at appropriate locations on a forming die to reduce the number of scraps produced by the forming die.

Figure 5:
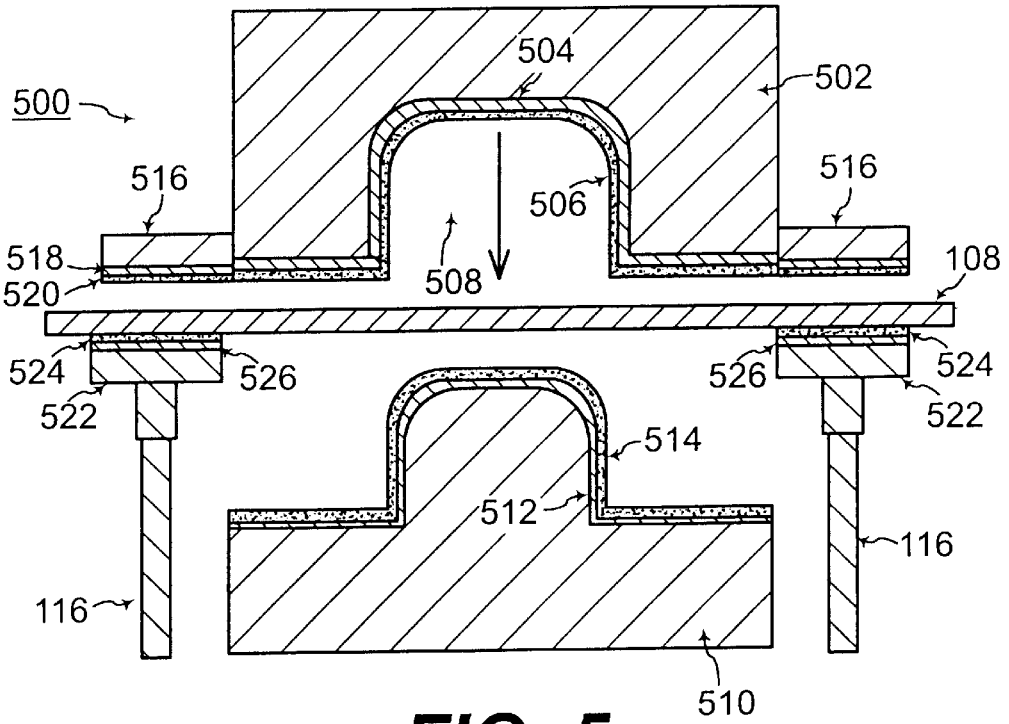
FIG. 5 shows a cross sectional view of a forming die of a stamping press including application of a dry lubricant and hard chrome to appropriate parts of the forming die, according to one embodiment of the present invention.

Referring to FIG. 5, a forming die 500 of a stamping press of the present invention includes a die 502 having the lower surfaces of the die 502 coated with a layer of hard chrome 504 and a layer of dry lubricant 506 as shown in FIG. 5. The inner surface of the cavity 508 of the die 502 is coated with the layer of hard chrome 504 and the layer of dry lubricant 506.

In addition, the forming die 500 of the present invention includes a punch 510 having the upper surfaces of the punch 510 coated with a layer of hard chrome 512 and a layer of dry lubricant 514 as shown in FIG. 5. The outer surface of the protrusion of the punch is coated with the layer of hard chrome 512 and the layer of dry lubricant 506.

Furthermore, the forming die 500 of the present invention includes an upper binder 516 having a lower surface that is coated with a layer of hard chrome 518 and a layer of dry lubricant 520. A lower binder 522 in the forming die 500 has an upper surface that is coated with a layer of hard chrome 524 and a layer of dry lubricant 526. The lower binder 522 sits on top of the cushion system 116.

With the coating of the hard chrome and the dry lubricant to the surfaces of the forming die 500 as shown in FIG. 5, such surfaces are subject to less frictional force as the metal within the metal blank 108 flows when the die 502 and the punch 510 come together to form a part, as shown in FIG. 2.

The surfaces of the forming die 500 as shown in FIG. 5 may be coated with a layer of hard chrome using chrome plating processes known to one of ordinary skill in the art. In addition, a layer of dry lubricant may be applied onto the layer of hard chrome as shown in FIG. 5 using dry lubricant application processes known to one of ordinary skill in the art. For example, U.S. Pat. No. 3,632,368 to Nelson discloses high energy impingement of the dry lubricant onto a surface and is incorporated herein by reference. The dry lubricant may consist of molybdenum disulfide ($MoS_2$) or tungsten disulfide ($WS_2$) in an embodiment of the present invention.

While FIG. 5 illustrates the coating of each of the die 502, the punch 510, and the upper binder 516, and the lower binder 522, it should be apparent to one of ordinary skill in the art that the present invention may be advantageously used with coating at least one of the the die 502, the punch 510, and the upper binder 516, and the lower binder 522.

Alternatively, the present invention may advantageously be used with the at least one of the die, punch, and binder surfaces of the forming die coated with only the dry lubricant without a plating of hard chrome onto such surfaces, as would be apparent to one of ordinary skill in the art from the description herein. In that case, the frictional force against such surfaces during operation of the forming die is reduced, and the forming die 500 of the present invention produces parts with a reduced scrap rate.

With the dry lubricant applied on the surfaces of the forming die 500 as shown in FIG. 5, frictional force against such surfaces, when the metal within the metal blank 108 flows against such surfaces, is reduced. With hard chrome plated onto the surfaces of the forming die 500 as shown in FIG. 5, such surfaces are less likely to wear and deform with time.

With one application of the hard chrome and the dry lubricant on the surfaces of the forming die 500 as shown in FIG. 5, a plurality of parts may be manufactured from a plurality of metal blanks. In addition, with such application, the number of parts that may be produced within a lot with such application is increased considerably, and the scrap rate is decreased considerably. Applicants compared results without application of the hard chrome and the dry lubricant on the surfaces of a forming die as in the prior art and with application of the hard chrome and the dry lubricant on the surfaces of a forming die 500 as shown in FIG. 5 of the present invention. The stamping press used for the comparison was for manufacturing automotive parts used in the automotive industry.

In an example, without such application of the hard chrome and the dry lubricant, a lot size of approximately 5,000 to 6,000 parts was manufactured in a day with a forming die of the prior art with a scrap rate of approximately 40%. In contrast, in an example of the present invention, with the application of the hard chrome and the dry lubricant on the surfaces of the forming die 500 as shown in FIG. 5 of the present invention, the forming die of the present invention manufactured 23,000 parts with substantially a 0% scrap rate.

In addition, note that parts lubricant or washing oil may also be applied on the metal blank 108 before being fed into the binders 516 and 522 of the forming die 500. However, with the dry lubricant applied to the stamping press in the present invention, a parts lubricant may be diluted down or may not be used for an additional cost savings. Example types of parts lubricants include fatty acids as known to one of ordinary skill in the art. Washing oils are typically used in a forming process to clean the surfaces of the metal blank 108 before the metal blank 108 is fed into the binders 516 and 522, as known to one of ordinary skill in the art.

Figure 6:
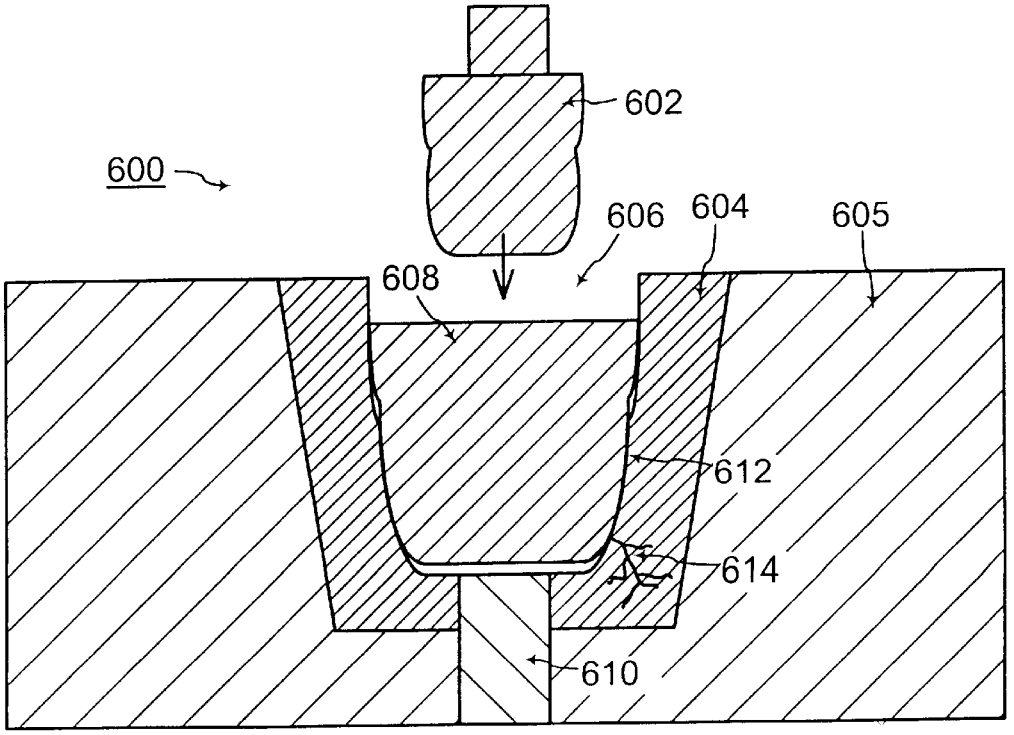
FIG. 6 (Prior Art)
FIG. 6 shows a cross section of a forging die of a forging press, according to the prior art.

In another embodiment of the present invention, a dry lubricant is applied on a forging die of a forging press. Referring to FIG. 6, a forging press includes a punch 602 and a forging die 600 having a forging die insert 604 placed inside a retaining ring 605. The forging die insert 604 has a cavity 606 for defining the shape of a part that is produced by the forging die 600.

During operation of the forging die 600, a preformed metal blank 608 is placed into the cavity 606 of the forging die insert 604. When a part is formed, the punch 602 is pushed into the metal blank 608 with high force such that the metal within the metal blank 608 flows and conforms to the shape of the punch 602 and the cavity 606. Once a part has thus been formed from the metal blank 608, the part is pushed out of the cavity 606 of the forging die insert 604 with an ejector pin 610 that pushes the part out of the cavity 606.

The three types of forging include cold forging, warm forging, and hot forging. In cold forging, the metal blank 608 is not heated before the punch 606 is pushed into the metal blank 608 within the cavity 606. In warm forging, the metal blank 608 is heated above ambient temperature to a predetermined temperature before the punch 606 is pushed into the metal blank 608 within the cavity 606, and the metal blank 608 is not molten. In hot forging, the metal blank 608 is heated to a relatively high temperature before the punch 606 is pushed into the metal blank 608 within the cavity 606. The present invention is especially advantageous in application to the cold forging process and the warm forging process.

In the prior art forging process, either a cold forging process or a warm forging process, a dry lubricant is not applied on an inner surface 612 of the cavity 606 of the forging die insert 604. To form a part from the metal blank 608, the punch 602 is pushed into the metal blank 608 with extreme high force such that metal within the metal blank 608 flows. The metal within the metal blank 608 flows against the inner surface 612 of the cavity 606 with high shear force.

If the inner surface 612 of the cavity 606 has any surface defects, the high shear force acting against such a surface defect results in damage to the forging die insert 604 such as by generating a crack 614. To prevent such damage, the inner surface of the cavity 606 is highly polished to have a near mirror smooth finish. However, any surface defect on the inner surface 612 of the cavity 606 may result in a short usable life of the forging die insert 604.

For example, use of a forging die for producing automotive parts showed that the usable life of the forging die 600 has a wide range from producing approximately 200 parts to approximately 10,000 parts. If the inner surface 612 of the cavity 606 has any surface defects, then the usable life of the forging die 600 had a shorter usable life of producing approximately 200 parts before the forging die insert 604 had damage as illustrated in FIG. 6. When the inner surface 612 of the cavity 606 was polished well such that the inner surface 602 had minimal surface defects, then the usable life of the forging die 600 had a longer usable life of approximately 10,000 parts before the forging die insert 604 failed.

Figure 7:
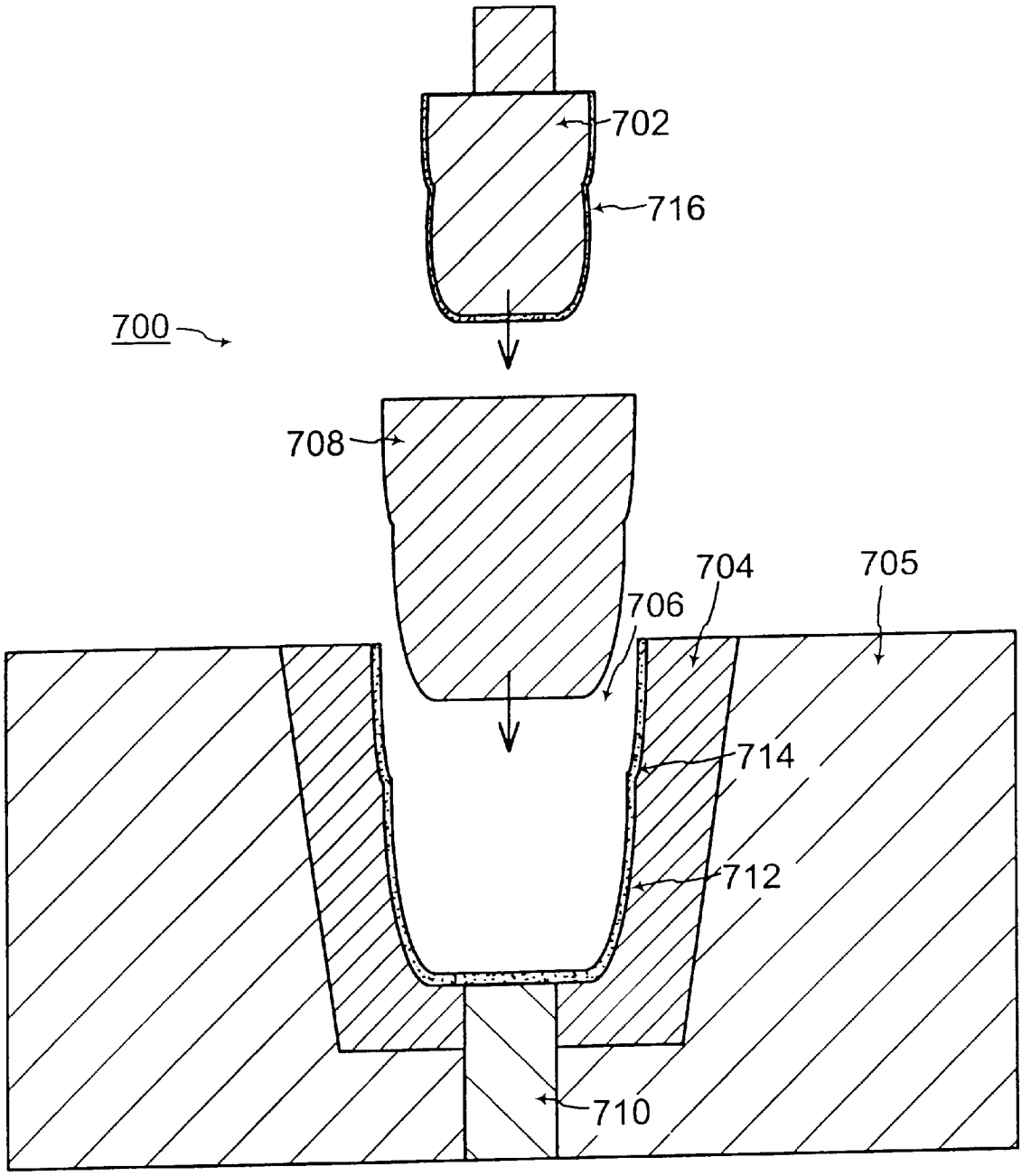
FIG. 7 shows a cross sectional view of a forging die of a forging press including application of a dry lubricant to appropriate parts of the forging die, according to one embodiment of the present invention.

Referring to FIG. 7, a forging press includes a punch 702 and a forging die 700 of the present invention which has a forging die insert 704 having a cavity 706 for holding a metal blank 708 as in the prior art. The forging die insert 704 is placed into a retaining ring 705. The punch 702 is pushed into the metal blank 708 within the cavity 706 with high force such that the metal within the metal blank 708 flows and conforms to the shape of the punch 702 and the cavity 706. Once a part has thus been formed from the metal blank 708, the part is pushed out of the cavity 706 of the forging die insert 704 with an ejector pin 710 that pushes the part out of the cavity 706.

The forging die 700 of the present invention further includes a dry lubricant 714 applied on the inner surface 712 of the cavity 706. The layer of dry lubricant 714 may be applied on the inner surface 712 of the cavity 706 as shown in FIG. 7 using dry lubricant application processes known to one of ordinary skill in the art. For example, U.S. Pat. No. 3,632,368 to Nelson discloses high energy impingement of the dry lubricant onto a surface and is incorporated herein by reference. The dry lubricant may consist of molybdenum disulfide ($MoS_2$) or tungsten disulfide ($WS_2$) in an embodiment of the present invention.

The layer of dry lubricant 714 minimizes the shear force applied against the inner surface 712 of the cavity 706 as the metal within the metal blank 708 flows against the inner surface 712 of the cavity 706 when the punch 708 is pushed into the metal blank 708 within the cavity 706 with high force. With such minimized shear force, the forging die insert 704 is less prone to damage from surface defects on the inner surface 712 of the cavity 706, and the usable life of the forging die insert 704 is prolonged.

With one application of the dry lubricant on the inner surface 712 of the cavity 706 as shown in FIG. 7, a plurality of parts may be manufactured from a plurality of metal blanks. Applicants compared results without application of the dry lubricant on the inner surface 612 of the cavity 606 as in the prior art and with application of the dry lubricant on the inner surface 712 of the cavity 706 as shown in FIG.

7 of the present invention. The forging press used for the comparison was for manufacturing automotive parts used in the automotive industry.

While the forging die insert 704 and the retaining ring 705 are illustrated in FIG. 7 as separate parts, it should be apparent to one of ordinary skill in the art that the present invention may be used with the die insert 704 and the retaining ring 705 being formed as a single element.

In the prior art, without such application of the dry lubricant to the inner surface 612 of the cavity 606, the usable life of the forging die insert 604 varied from approximately 200 parts to approximately 10,000 parts. The low usable life of 200 parts results from damage to the forging die insert 604 when a surface defect is present on the inner surface 612 of the cavity 606. In contrast, with the layer of dry lubricant 714 on the inner surface 712 of the forging die insert 704 as shown in FIG. 7 of the present invention, the usable life of the forging die insert 704 varied from approximately 6,000 parts to approximately 10,000 parts. Thus, the layer of dry lubricant 714 on the inner surface 712 of the forging die insert 704 as shown in FIG. 7 prolongs the usable life of the forging die insert 704 even when minor surface defects exist on the inner surface 712 of the cavity 706.

In this manner, a layer of dry lubricant is used for producing parts in a forming die of a stamping press that has high frictional force applied thereon as metal within a metal blank is formed and in a forging die of a forging press that has high shear force applied thereon as metal within a metal blank flows. The dry lubricant applied to appropriate components of the forming die and the forging die minimizes the frictional force and the shear force on the forming die and the forging die respectively. Thus, the forming die of the present invention may be used to produce more parts in a given period of time with reduced scrap. In addition, the usable life of the forging die may be prolonged to produce a higher number of parts from a forging die insert.

The foregoing is by way of example only and is not intended to be limiting. For example, in the forming die of the present invention, the dry lubricant may be applied to any of the die 502, the punch 510, and the binder 522 with or without a plating of the hard chrome on such parts. Alternatively, the dry lubricant may be applied to at least one of the die 502, the punch 510, and the binder 522 of the forming die or to all of such components of the forming die.

In addition, a layer of dry lubricant 716 may be applied to the surface of the punch 702 in the forging die 700 of the present invention as shown in FIG. 7 to prolong the usable life of the punch 702. The layer of dry lubricant 716 on the surface of the punch 702 minimizes the shear force applied against the surface of the punch 702 as the punch 702 is pushed into the metal blank 708 with high force. Thus, damage to the punch 702 from the shear force is minimized, and the usable life of the punch 702 is prolonged.

The present invention is limited only as defined in the following claims and equivalents thereof.

We claim:

1. A method for operating a forming die, of a stamping press, to reduce scrap, the method including the steps of:

A. applying a dry lubricant to at least one of a die and a punch of said forming die;

B. feeding a metal blank to be held by a binder, of said forming die, between said die and said punch;

C. stamping a part from said metal blank by moving at least one of said die and said punch with high force such that said die and said punch come together while said metal blank is held by said binder between said punch and said die; and D. repeating steps B and C to produce a plurality of parts from a plurality of metal blanks with one application of said dry lubricant to said die and said punch of said forming die.

2. The method of claim 1, further including the step of:

applying a dry lubricant to said binder of said forming die.

3. A method for operating a forming die, of a stamping press, to reduce scrap, the method including the steps of:

A. plating a die, a punch, and a binder of said forming die with hard chrome;

B. applying a dry lubricant comprising tungsten disulfide ($WS_2$) to said die, said punch, and said binder of said forming die using a high energy impingement process;

C. applying one of a parts lubricant and a washing oil to a metal blank;

D. feeding said metal blank to be held by said binder between said die and said punch;

E. stamping an automotive part from said metal blank by moving at least one of said die and said punch with high force such that said die and said punch come together while said metal blank is held by said binder between said punch and said die; and F. repeating steps C, D, and E to produce a plurality of automotive parts from a plurality of metal blanks with one application of said dry lubricant to said die, said punch, and said binder of said stamping press.

4. A forming die, of a stamping press, having parts designed to minimize scrap, the forming die comprising:

a die having a cavity for defining the shape of a part to be produced by said forming die;

a punch having a protrusion corresponding to said cavity of said die for defining the shape of said part;

a binder that holds a metal blank between said die and said punch, wherein said part is stamped by moving at least one of said punch and said die with high force such that said die and said punch come together while said metal blank is held by said binder between said punch and said die; and a layer of dry lubricant applied on at least one of said die, said punch, and said binder of said forming die.

5. The forming die of claim 4, wherein said dry lubricant is applied to said at least one of said die, said punch, and said binder with a high energy impingement process.

6. The forming die of claim 4, wherein said dry lubricant is comprised of tungsten disulfide ($WS_2$).

7. The forming die of claim 4, wherein said stamping press produces automotive parts.

8. The forming die of claim 4, wherein said metal blank has one of parts lubricant and washing oil applied thereon before being fed to be held by said binder.

9. The forming die of claim 4, wherein said layer of dry lubricant is applied to all of said die, said punch, and said binder.

10. A forming die, of a stamping press, having parts designed to minimize scrap, the forming die comprising:

a die having a cavity for defining the shape of a part to be produced by said forming die;

a punch having a protrusion corresponding to said cavity of said die for defining the shape of said part;

a binder that holds a metal blank between said die and said punch, wherein said part is stamped by moving at least one of said punch and said die with high force such that said die and said punch come together while said metal blank is held by said binder between said punch and said die; and a layer of dry lubricant applied on at least one of said die, said punch, and said binder of said forming die;

wherein said layer of dry lubricant is applied to all of said die, said punch, and said binder, and wherein said hard chrome is plated onto all of said die, said punch, and said binder before said layer of dry lubricant is applied thereon.

11. A method for operating a forming die, of a stamping press, to reduce scrap, the method including the steps of:

A. applying a dry lubricant to at least one of a die, a punch, and a binder of said forming die;

B. feeding a metal blank to be held by said binder between said die and said punch;

C. stamping a part from said metal blank by moving at least one of said die and said punch with high force such that said die and said punch come together while said metal blank is held by said binder between said punch and said die; and D. repeating steps B and C to produce a plurality of parts from a plurality of metal blanks with one application of said dry lubricant to at least one of said die, said punch, and said binder of said forming die;

wherein said dry lubricant is applied to all of said die, said punch, and said binder in said step A, and wherein said hard chrome is plated onto all of said die, said punch, and said binder before said dry lubricant is applied thereon.

12. A method for operating a forming die, of a stamping press, to reduce scrap, the method including the steps of:

A. applying a dry lubricant to at least one of a die, a punch, and a binder of said forming die;

B. feeding a metal blank to be held by said binder between said die and said punch;

C. stamping a part from said metal blank by moving at least one of said die and said punch with high force such that said die and said punch come together while said metal blank is held by said binder between said punch and said die;

D. repeating steps B and C to produce a plurality of parts from a plurality of metal blanks with one application of said dry lubricant to at least one of said die, said punch, and said binder of said forming die; and E. plating with hard chrome said at least one of said die, said punch, and said binder that has said dry lubricant applied thereon in said step A before said dry lubricant is applied thereon.

13. The method of claim 12, wherein said dry lubricant is applied with a high energy impingement process.

14. The method of claim 12, wherein said dry lubricant is comprised of tungsten disulfide ($WS_2$).

15. The method of claim 12, wherein said parts produced by said forming die are automotive parts.

16. The method of claim 12, further including the step of:

applying one of parts lubricant and washing oil to said metal blank before feeding said metal blank to be held by said binder in said step B.

17. The method of claim 12, wherein said dry lubricant is applied to all of said die, said punch, and said binder in said step A and wherein said hard chrome is plated onto all of said die, said punch, and said binder before said dry lubricant is applied thereon.

18. A forming die, of a stamping press, having parts designed to minimize scrap, the forming die comprising:

a die having a cavity for defining the shape of a part to be produced by said forming die;

a punch having a protrusion corresponding to said cavity of said die for defining the shape of said part;

a binder that holds a metal blank between said die and said punch, wherein said part is stamped by moving at least one of said punch and said die with high force such that said die and said punch come together while said metal blank is held by said binder between said punch and said die;

a layer of dry lubricant applied on at least one of said die, said punch, and said binder of said forming die; and a layer of hard chrome plated on said at least one of said die, said punch, and said binder, that has said dry lubricant applied thereon, said layer of hard chrome being plated thereon before said dry lubricant is applied thereon.

19. The forming die of claim 18, wherein said dry lubricant is applied to said at least one of said die, said punch, and said binder with a high energy impingement process.

20. The forming die of claim 18, wherein said dry lubricant is comprised of tungsten disulfide ($WS_2$).

21. The forming die of claim 18, wherein said stamping press produces automotive parts.

22. The forming die of claim 18, wherein said metal blank has one of parts lubricant and washing oil applied thereon before being fed to be held by said binder.

23. The forming die of claim 18, wherein said layer of dry lubricant is applied to all of said die, said punch, and said binder, and wherein said hard chrome is plated onto all of said die, said punch, and said binder before said layer of dry lubricant is applied thereon.

24. A method for operating a forming die, of a stamping press, to reduce scrap, the method including the steps of:

A. applying a dry lubricant to at least one of a die, a punch, and a binder of said forming die;

B. feeding a metal blank to be held by said binder between said die and said punch;

C. stamping a part from said metal blank by moving at least one of said die and said punch with high force such that said die and said punch come together while said metal blank is held by said binder between said punch and said die; and D. repeating steps B and C to produce a plurality of parts from a plurality of metal blanks with one application of said dry lubricant to at least one of said die, said punch, and said binder of said forming die.

25. The method of claim 24, wherein said dry lubricant is applied with a high energy impingement process.

26. The method of claim 24, wherein said dry lubricant is comprised of tungsten disulfide ($WS_2$).

27. The method of claim 24, wherein said parts produced by said forming die are automotive parts.

28. The method of claim 24, further including the step of:

applying one of parts lubricant and washing oil to said metal blank before feeding said metal blank to be held by said binder in said step B.

29. The method of claim 1, wherein said dry lubricant is applied to all of said die, said punch, and said binder in said step A.

30. A method for operating a forging press having a forging die, to prolong usable life of said forging die, said forging press having a punch, and said forging die having a cavity for defining the shape of a part to be produced by the forging press, the method including the steps of:

A. applying a dry lubricant onto an inner surface of said cavity of said forging die;

B. placing a metal blank into said cavity of said forging die;

C. forming a part from said metal blank by pushing a punch into said metal blank placed in said cavity of said forging die with high force such that metal within said metal blank flows and conforms to the shape of said punch and said cavity of said forging die; and D. repeating steps B and C to produce a plurality of parts from a plurality of metal blanks with one application of said dry lubricant onto said inner surface of said cavity of said forging die.

31. The method of claim 30, wherein said dry lubricant is applied onto said inner surface of said cavity of said forging die with a high energy impingement process.

32. The method of claim 30, wherein said dry lubricant is comprised of tungsten disulfide ($WS_2$).

33. The method of claim 30, wherein said parts produced by said forging die includes automotive parts.

34. The method of claim 30, further including the step of:

applying a layer of dry lubricant onto said punch to prolong usable life of said punch.

35. The method of claim 30, wherein said forging die comprises a forging die insert placed into a retaining ring.

36. The method of claim 30, wherein said forging die comprises a forging die insert and a retaining ring which are formed as a single element.

37. A forging press comprising:

a forging die having a cavity for defining the shape of a part to be produced by said forging die from a metal blank placed into said cavity of said forging die;

a punch having a protrusion shape for defining the shape of said part when said punch is pushed into said metal blank, placed in said cavity of said forging die, with high force such that metal within said metal blank flows and conforms to the shape of said punch and said cavity of forging die; and a layer of dry lubricant applied onto an inner surface of said cavity of said forging die to minimize frictional force on said inner surface of said cavity of said forging die such that usable life of said forging die is prolonged.

38. The forging press of claim 37, wherein said dry lubricant is applied onto said inner surface of said cavity of said forging die with a high energy impingement process.

39. The forging press of claim 37, wherein said dry lubricant is comprised of tungsten disulfide ($WS_2$).

40. The forging press of claim 37, wherein said forging press produces automotive parts.

41. The forging press of claim 37, further comprising:

a layer of dry lubricant applied onto a surface of said punch of said forging die to minimize frictional force on said surface of said punch such that usable life of said punch is prolonged.

42. The forging press of claim 37, wherein said forging die comprises a forging die insert placed into a retaining ring.

43. The forging press of claim 37, wherein said forging die comprises a forging die insert and a retaining ring which are formed as a single element.

* * * * *